US007810963B2

(12) United States Patent
Peck

(10) Patent No.: US 7,810,963 B2
(45) Date of Patent: Oct. 12, 2010

(54) LIGHT EMITTING DIODE MODULE WITH IMPROVED LIGHT DISTRIBUTION UNIFORMITY

(75) Inventor: John Patrick Peck, Manasquan, NJ (US)

(73) Assignee: Dialight Corporation, Farmingdale, NJ (US)

( * ) Notice: Subject to any disclaimer, the term of this patent is extended or adjusted under 35 U.S.C. 154(b) by 122 days.

(21) Appl. No.: 11/684,453

(22) Filed: Mar. 9, 2007

(65) Prior Publication Data

US 2007/0211473 A1 Sep. 13, 2007

Related U.S. Application Data

(60) Provisional application No. 60/781,241, filed on Mar. 10, 2006.

(51) Int. Cl.
*F21V 7/00* (2006.01)

(52) U.S. Cl. ..... 362/346; 362/350; 362/249.02

(58) Field of Classification Search ..... 362/347, 362/245, 241, 247, 328, 343, 349, 350, 346, 362/800
See application file for complete search history.

(56) References Cited

U.S. PATENT DOCUMENTS 1,975,879 A * 10/1934 Tuck ..... 40/553
3,835,342 A * 9/1974 Freeman ..... 313/114
4,229,782 A 10/1980 Ruud et al.
4,612,608 A * 9/1986 Peitz ..... 362/297
4,964,025 A * 10/1990 Smith ..... 362/346
5,077,644 A * 12/1991 Schaller et al. ..... 362/184
5,486,983 A * 1/1996 Cordier et al. ..... 362/29
5,490,049 A * 2/1996 Montalan et al. ..... 362/240
5,580,156 A * 12/1996 Suzuki et al. ..... 362/184
5,894,195 A 4/1999 McDermott
5,947,587 A * 9/1999 Keuper et al. ..... 362/235
6,206,549 B1 3/2001 Li
6,210,027 B1 * 4/2001 Fadel et al. ..... 362/518
6,513,950 B1 2/2003 Ono
6,616,299 B2 * 9/2003 Martineau ..... 362/244
6,637,912 B2 * 10/2003 Arumugasaamy et al. ... 362/327
6,796,698 B2 9/2004 Sommers et al.
2004/0252520 A1 12/2004 Martineau et al.
2006/0138440 A1 * 6/2006 Jyo ..... 257/98
2007/0257272 A1 * 11/2007 Hutchins ..... 257/98

OTHER PUBLICATIONS

International Search Report and Written Opinion of PCT/US07/06125; contains 9 pages.

* cited by examiner

*Primary Examiner*—Gunyoung T Lee

(57) ABSTRACT

In one embodiment, the invention is a light emitting diode module with improved light distribution uniformity. One embodiment of a signal head includes a light emitting diode and a reflector cup positioned to reflect light emitted by the light emitting diode, the reflector cup having a non-symmetrical curvature.

20 Claims, 11 Drawing Sheets

LIGHT EMITTING DIODE MODULE WITH IMPROVED LIGHT DISTRIBUTION UNIFORMITY

CROSS REFERENCE TO RELATED APPLICATIONS

This application claims the benefit of U.S. Provisional Patent Application Ser. No. 60/781,241, filed Mar. 10, 2006, which is herein incorporated by reference in its entirety.

BACKGROUND OF THE INVENTION

The present invention relates generally to a light source, and relates more particularly to a light emitting diode (LED)-based signal head.

Traffic lights, rail lights and other signal heads often suffer from poor light uniformity across the lens surface. Poor light uniformity is distracting and is typically considered objectionable. The Institute for Transportation Engineers (ITE) has recently set a lens luminance uniformity requirement for a round traffic ball of ten to one. This means that no area of the lens can be ten times brighter than any other area of the lens.

In some traffic light designs, a large number of low-power LEDs are arranged uniformly across the traffic front of the signal head. This gives a "pixelated" appearance which is often objectionable. In another design, a small number of high-power LEDs are concentrated in the center of the light. This design results in a bright center area of the outer lens and a less bright perimeter of the outer lens.

Thus, there is a need in the art for a light emitting diode module with improved light distribution uniformity.

SUMMARY OF THE INVENTION

In one embodiment, the invention is a light emitting diode module with improved light distribution uniformity. One embodiment of a signal head includes a light emitting diode and a reflector cup positioned to reflect light emitted by the light emitting diode, the reflector cup having a non-symmetrical curvature.

BRIEF DESCRIPTION OF THE DRAWINGS

So that the manner in which the above recited features of the present invention can be understood in detail, a more particular description of the invention, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In one embodiment, the present invention is a light emitting diode-based signal head. Embodiments of the present invention address the problems of conventional signal head designs by providing an LED light source and an optical system that spreads the light emitted therefrom more uniformly across the lens of a signal assembly than conventional systems.

Figure 1:
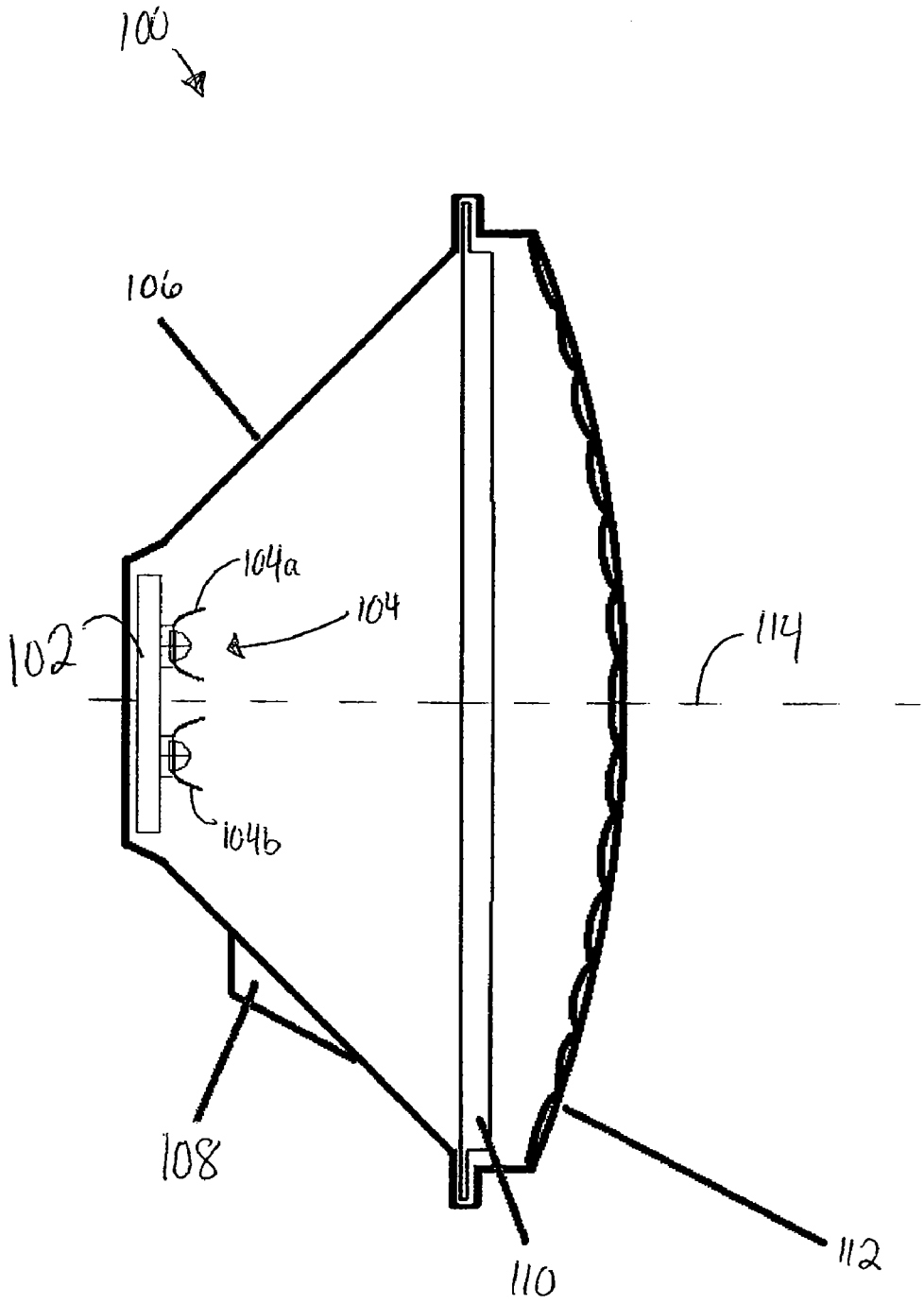
FIG. 1 depicts one embodiment of a traffic head assembly that may be adapted to benefit from the present invention.

FIG. 1 depicts one embodiment of a traffic head assembly 100 that may be adapted to benefit from the present invention. The assembly 100 comprises an LED array 102 comprising at least one LED and a reflector optic 104 surrounding the LED array 102. The reflector optic 104 comprises a plurality of reflecting surfaces (e.g., reflector cups 104*a*-104*n*) associated with at least one optical axis 114. In one embodiment, the reflector optic 104 is formed from at least one of: a metal, a metalized surface or a reflectorized surface. In another embodiment, the reflector optic 104 is formed of plastic or glass that reflects light through total internal reflection.

In one embodiment, the assembly 100 also comprises a housing 106, a power supply 108, and additional lenses positioned to manipulate light emitted from the LED array 102. In one embodiment, the additional lenses include a Fresnel lens 110 and a spreading lens 112. In one embodiment, both the Fresnel lens 110 and the spreading lens 112 have a diameter of approximately eight inches, and the distance from the Fresnel lens 110 and the spreading lens 112 to the LED array 102 and reflector optic 104 is approximately three inches. In another embodiment, both the Fresnel lens 110 and the spreading lens 112 have a diameter of approximately twelve inches, and the distance from the Fresnel lens 110 and the spreading lens 112 to the LED array 102 and reflector optic 104 is approximately four and one half inches. In one embodiment, these dimensions have a tolerance of ±25%. In one embodiment, these dimensions correspond to an aspect ratio of 2.7. In one embodiment, this aspect ratio has a tolerance of ±25%.

The power supply 108 supplies power to the LED array 102, which emits light in the form of beams from the plurality of LEDs. The emitted light is reflected by the reflector optic 104 and received by the Fresnel lens 110, which collimates the light into a single beam before the light is received by the spreading lens 112. The spreading lens 112 spreads the collimated light in accordance with a desired distribution, for which the spreading lens 112 is configured. The use of the reflector optic 104 to reflect the light emitted by the LED array 102 substantially prevents the emitted light from being directed into the housing 106 and lost.

Figure 7:
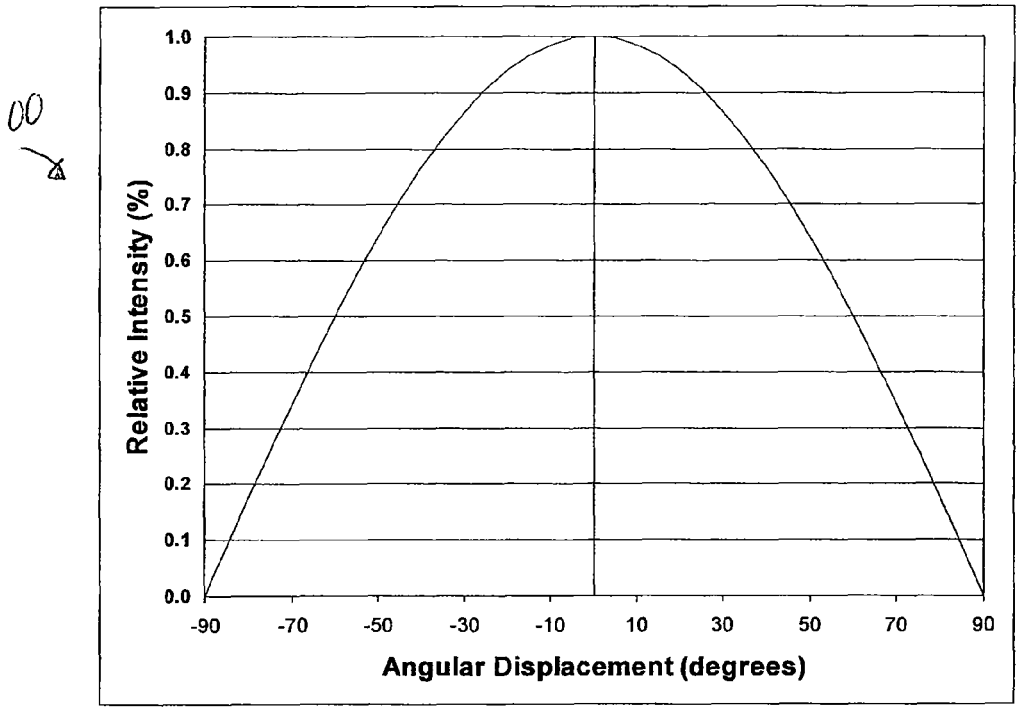
FIG. 7 is a graph depicting a representation of relative light intensity versus angular displacement, for light typically emitted from an LED.

FIG. 7 is a graph 700 depicting a representation of relative light intensity versus angular displacement, for light typically emitted from an LED. As illustrated, the light output patterns of LEDs generally follow a cosine distribution. A reflector optic can be used to reflect the high-angle light from an LED into the lens (e.g., Fresnel lens and/or spreading lens) of a traffic head assembly. As discussed above, without the reflector optic, this light would be directed into the housing of the traffic head assembly and lost.

Figure 2:
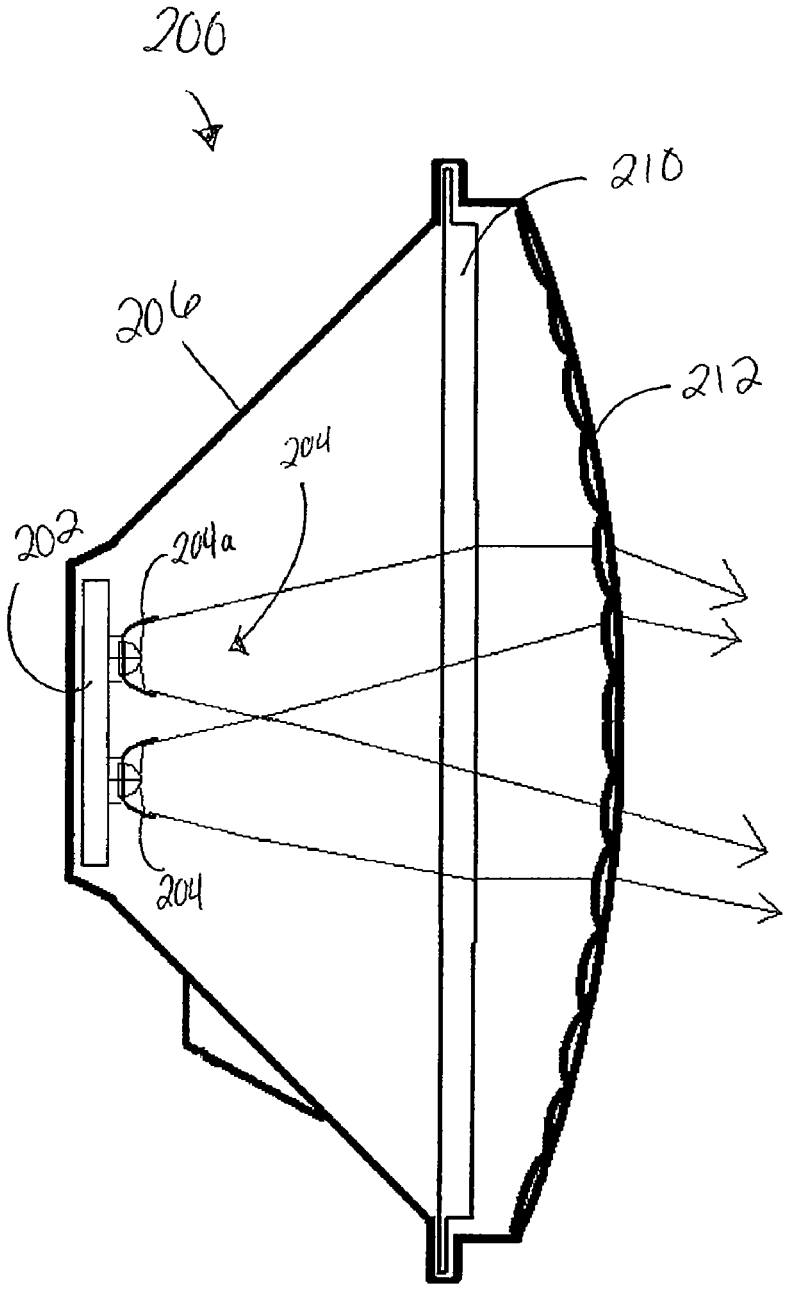
FIG. 2 depicts a second embodiment of a traffic head assembly that may be adapted to benefit from the present invention.
Figure 4:
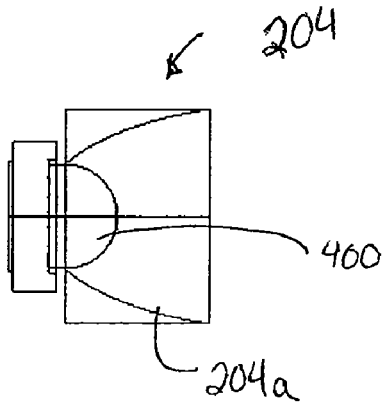
FIG. 4 depicts one embodiment of a reflector optic.

FIG. 2 depicts a second embodiment of a traffic head assembly 200 that may be adapted to benefit from the present invention. Like the assembly 100, the assembly 200 comprises an LED array 202 comprising a plurality of LEDs and a reflector optic 204 surrounding the LED array 202. Specifically, as illustrated in more detail in FIG. 4, which depicts one embodiment of a reflector optic 204, the reflector optic 204 comprises a plurality of reflector cups 204*a*-204*n*, each reflector cup 204*a*-204*n* being positioned around an individual LED 400. The illustrated reflector cup 204*a* has revolved and surface symmetry. Referring back to FIG. 2, in one embodiment, the assembly 200 also comprises a housing 206, a Fresnel lens 210 and a spreading lens 212.

As illustrated, the LED array 202 and reflector optic 204 are configured so that light emitted by the LED array 202 is not tilted (i.e., is received substantially straight on or at a minimal angle by the Fresnel lens 210 and spreading lens 212). As a result, the light emitted by the LED array 202 is concentrated substantially at the center of the spreading lens 212, such that the center of the spreading lens 212 is much brighter than the perimeter of the spreading lens 212 (i.e., a "hot spot" is created in the center of the spreading lens 212). In this case, the rays from the individual reflector cups overlap, as illustrated.

Figure 3A:
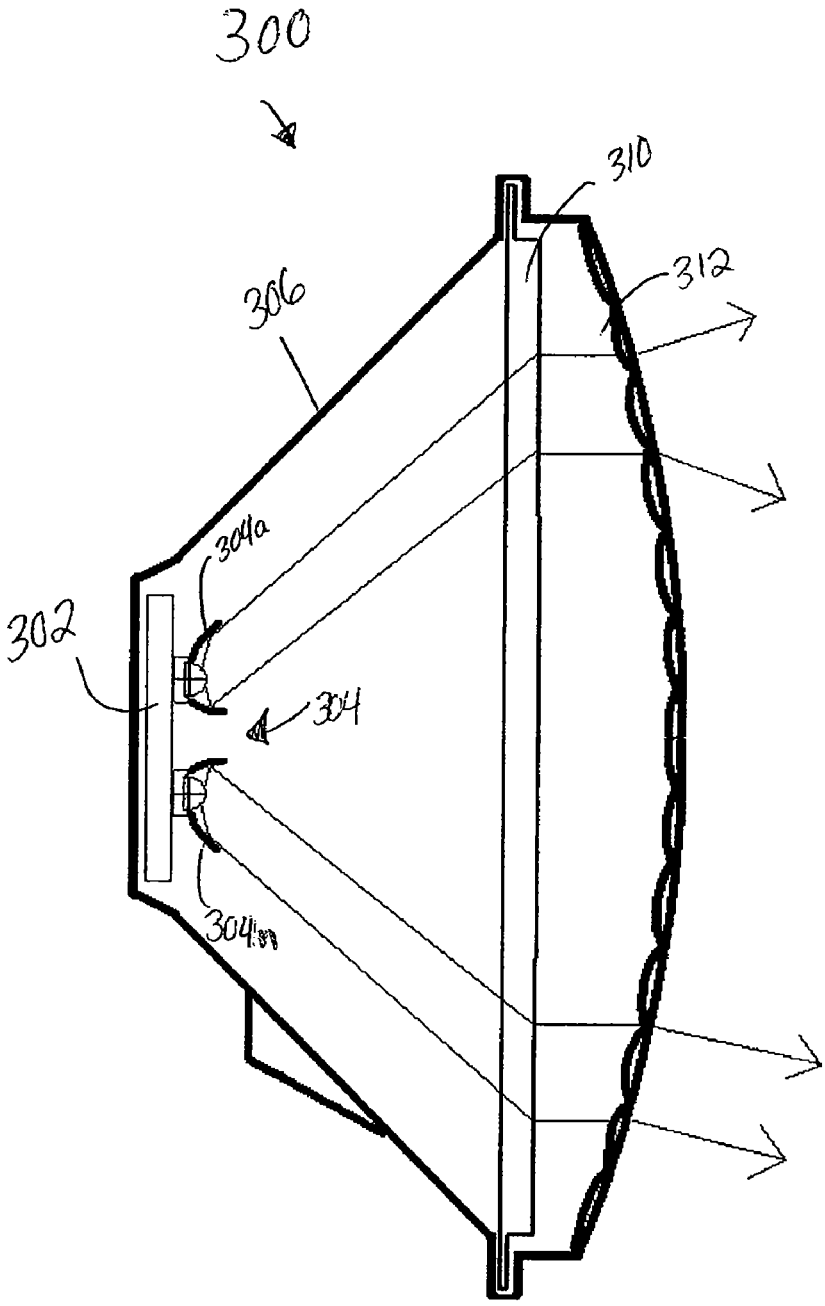
FIGS. 3A and 3B depict a third embodiment of a traffic head assembly that may be adapted to benefit from the present invention.
Figure 3B:
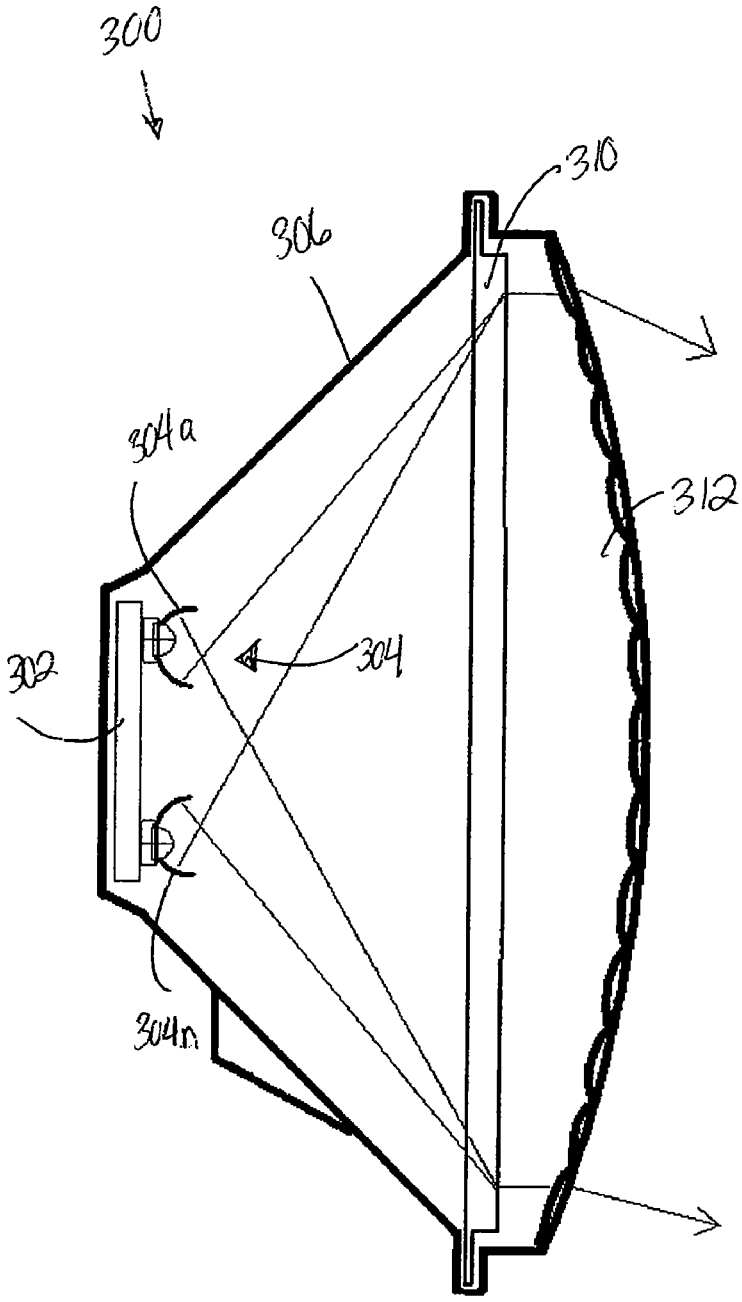
Figure 5:
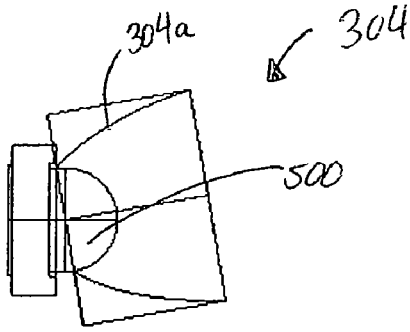
FIG. 5 depicts a second embodiment of a reflector optic.

FIGS. 3A and 3B depict a third embodiment of a traffic head assembly 300 that may be adapted to benefit from the present invention. Like the assembly 100, the assembly 300 comprises an LED array 302 comprising a plurality of LEDs and a reflector optic 304 surrounding the LED array 302. Specifically, as illustrated in more detail in FIG. 5, which depicts a second embodiment of a reflector optic 304, the reflector optic 304 comprises a plurality of reflector cups 304*a*-304*n*, each reflector cup 304*a*-304*n* being positioned around an individual LED 500. Referring back to FIG. 3, in one embodiment, the assembly 300 also comprises a housing 306, a Fresnel lens 310 and a spreading lens 312.

As illustrated, the LED array 302 and reflector optic 304 are configured so that light emitted by the LED array 302 is tilted (i.e., is received at an angle by the Fresnel lens 310 and spreading lens 312). As a result, the light emitted by the LED array 302 is directed toward the outer perimeter of the spreading lens 312, giving a more uniform illumination than the assembly 200 illustrated in FIG. 2. In the case of FIG. 3A, the rays from the reflector cups 304*a*-304*n* do not overlap; however, in the case of FIG. 3B, the rays from the reflector cups 304*a*-304*n* do overlap. It is noted that the perimeter of the spreading lens 312 will typically be best illuminated if each reflector cup 304*a*-304*n* in the reflector optic 304 is tilted toward a different point on the perimeter of the spreading lens 312. The reflector cups 304*a*-304*n* can be tilted upward, downward, to either side or to any other radial angle.

Figure 6A:
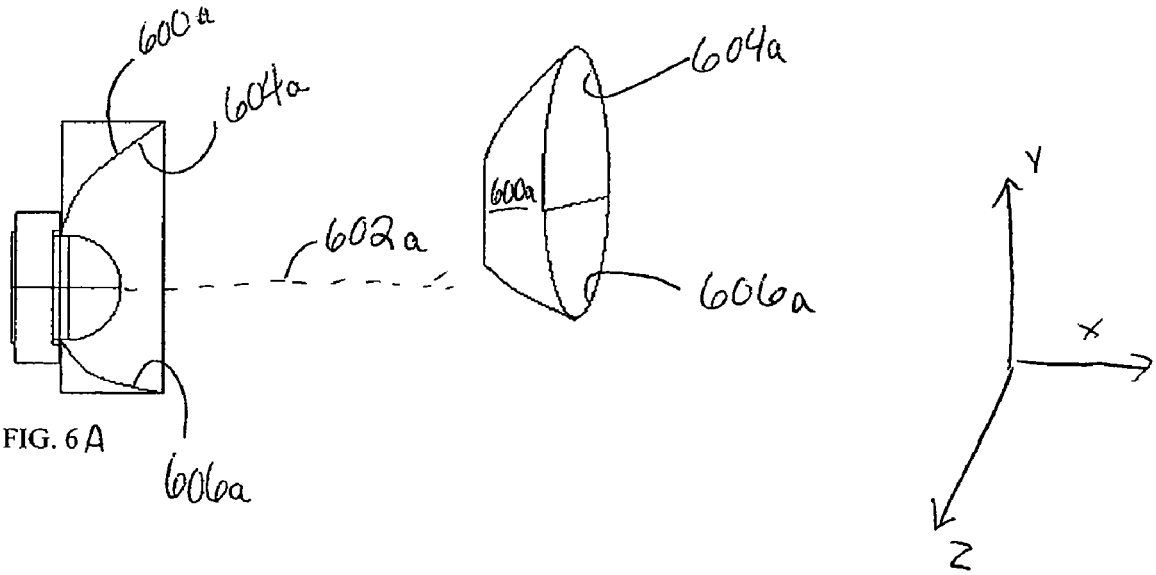
FIG. 6A depicts a third embodiment of a reflector optic.

In one embodiment, the reflector cups are not tilted, but rather have non-symmetric curvature in order to achieve the tilted reflector effect. FIG. 6A, for example, depicts a third embodiment of a reflector optic 600*a* (i.e., reflector cup), in which the curvature of the reflector optic 600*a* is non-symmetric about a center axis 602*a*. That is, a first section 604*a* of the reflector optic's perimeter has a larger radius than a second section 606*a* of the reflector optic's perimeter. The non-symmetric curvatures may be "blended" together along the sidewalls of the reflector optic 600*a*. By altering the curvature of the reflecting surface non-symmetrically with respect to the center axis 602*a*, light is tilted/directed away from center axis 602*a*. In one embodiment, the curvature at any one point on the reflector optic 600*a* is between approximately zero degrees and approximately ninety degrees with respect to the center axis 602*a*. In one embodiment, the resultant tilt has a tolerance of ±10°.

Figure 6B:
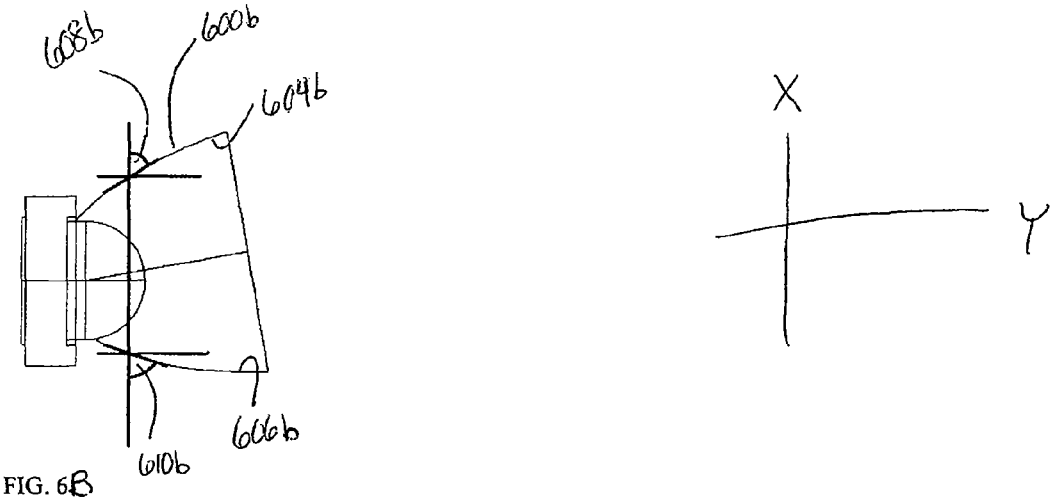
FIG. 6B depicts a fourth embodiment of a reflector optic.

FIG. 6B, on the other hand, depicts a fourth embodiment of a reflector optic 600*b* (i.e., reflector cup), in which the slope of the reflector optic 600*b* is non-uniform. That is, a first section 604*b* of the reflector optic's perimeter has a higher slope than a second section 606*b* of the reflector optic's perimeter. For example, as illustrated, a first angle 608*b* between a vertical line and the slope of the first section 604*b* is less than a second angle 610*b* between the same vertical line and the second section 606*b*. In one embodiment, the second angle 608*b* is at least five degrees greater than the first angle 610*b*.

Figure 9:
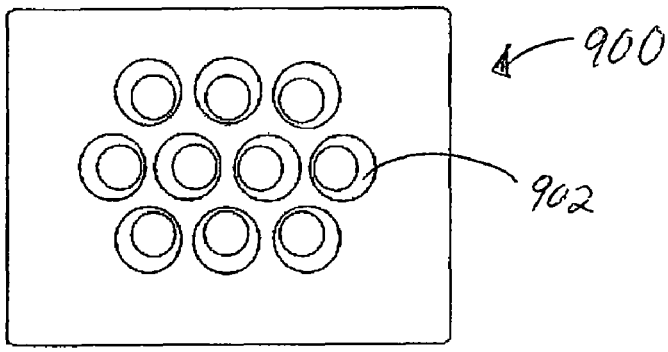
FIG. 9 depicts an array of reflector optics with non-symmetric curvature.

As illustrated in FIG. 9, which depicts an array 900 of reflector optics (i.e., reflector cups 902) with non-symmetric curvature, the reflector cups 902 can also be fanned out radially. In this case, the light/tilt angle can be a function of the position away from the central optical axis of a signal head assembly.

As discussed with respect to FIG. 6, one embodiment of an LED-based signal head assembly according to the present invention comprises a plurality of LEDS and reflector optics positioned around the LEDs, the reflector optics having reflector cups that tilt the light emitted from the LEDs non-symmetrically. In a further embodiment, the reflector optics have a conic or conic-like shape such as: a hyperbola, a parabola, an ellipse, a sphere, an oblate sphere or a modified conic. In a further embodiment still, the conic or conic-like shape includes segmented or faceted surfaces. The illumination/intensity pattern generated by an LED array will typically vary with the specific shape of the reflector optics.

Conic shapes are defined by:

$$z = \frac{cr^2}{1 + \sqrt{1 - (1 + k)c^2r^2}} \quad \text{(EQN. 1)}$$

where, $$r^2 = x^2 + y^2 \quad \text{(EQN. 2)}$$

x, y, and z are positions of the conic shape on a typical three-axis system, k is the conic constant, c is curvature of the conic shape, and C is a constant. In one embodiment, the conic constant k and the constant C are user-selected. As discussed above, hyperbolas ($k<-1$), parabolas ($k=-1$), ellipses ($-1<k<0$), spheres ($k=0$) and oblate spheres ($k>0$) are all conic shapes.

In one embodiment, the basic conic shape is modified using additional mathematical terms. For example, the basic conic shape can be modified in accordance with a polynomial asphere according to:

$$z = \frac{cr^2}{1 + \sqrt{1 - (1 + k)c^2r^2}} + F \quad \text{(EQN. 3)}$$

where F is an arbitrary function and in one embodiment is defined as:

$$\sum_{n=2}^{10} C_{2n} r^{2n} \quad \text{(EQN. 4)}$$

Conic shapes can also be reproduced or modified using a set of points and a basic curve, such as a spline fit. Thus, the desired illumination/intensity pattern output by an LED array can be realized by modifying the shape of the reflector optics.

Figure 8:
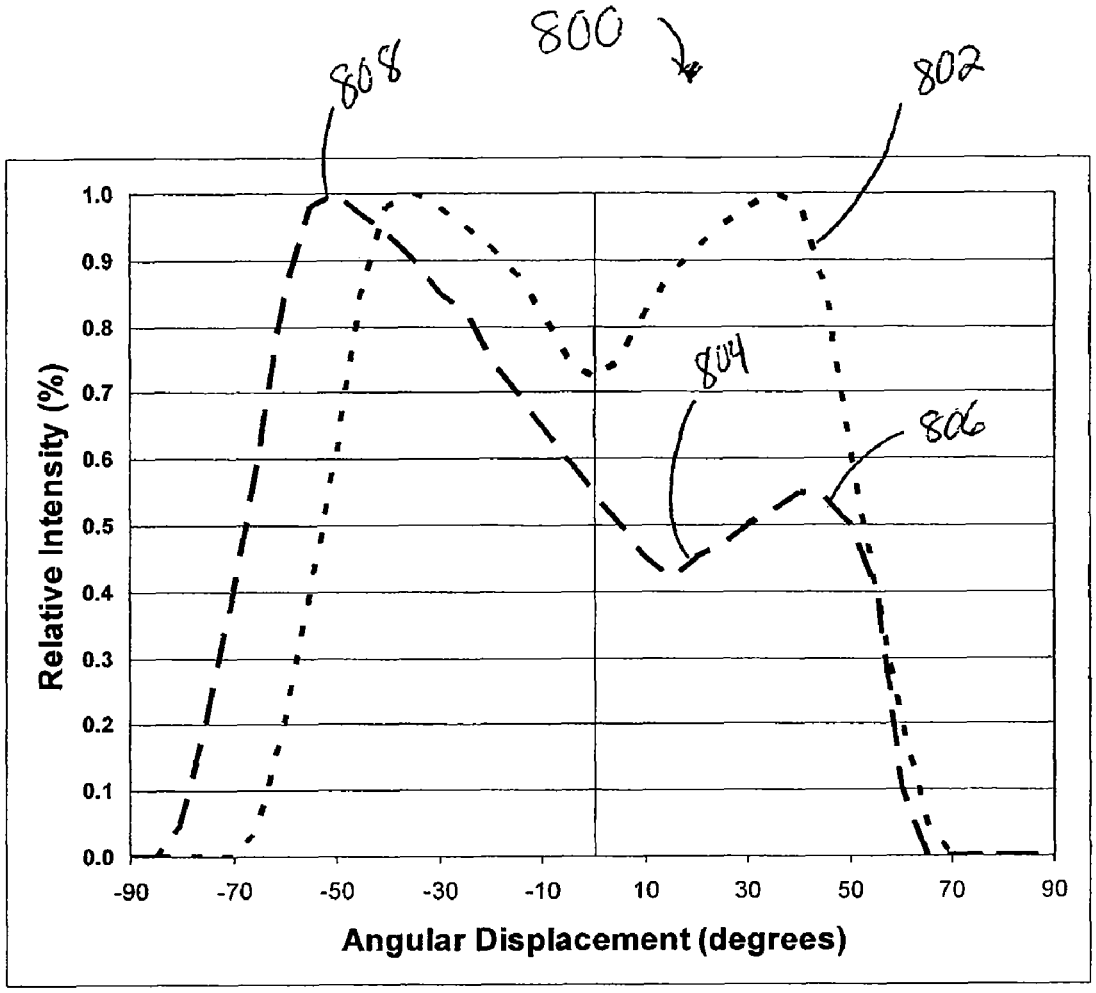
FIG. 8 is a graph depicting a representation of relative light intensity versus angular displacement, for light typically emitted from an LED reflector optic without tilt and also for light typically emitted from an LED reflector optic with tilt.

FIG. 8 is a graph 800 depicting a representation of relative light intensity versus angular displacement, for light typically emitted from an LED reflector optic without tilt (i.e., line 802) and also for light typically emitted from an LED reflector optic with tilt (i.e., line 804). In one embodiment, the tilt is generated by non-symmetric reflector optics.

As illustrated, the peak intensity for a positive angular displacement (e.g., point 806) is approximately fifty-five percent the peak intensity for a negative angular displacement (e.g., point 808) for the same embodiment (reflector optics with or without tilt). In one embodiment, the fifty-five percent has a tolerance of approximately ±10%. In one embodiment, the peak intensity for a positive angular displacement is shifted by approximately ten degrees with respect to the peak intensity for a negative angular displacement. In one embodiment, the lower edge intensity (i.e., the point where the intensity is less than ten percent of the peak) for a positive angular displacement is shifted by about ten degrees with respect to the lower edge intensity for a negative angular displacement.

Figure 10A:
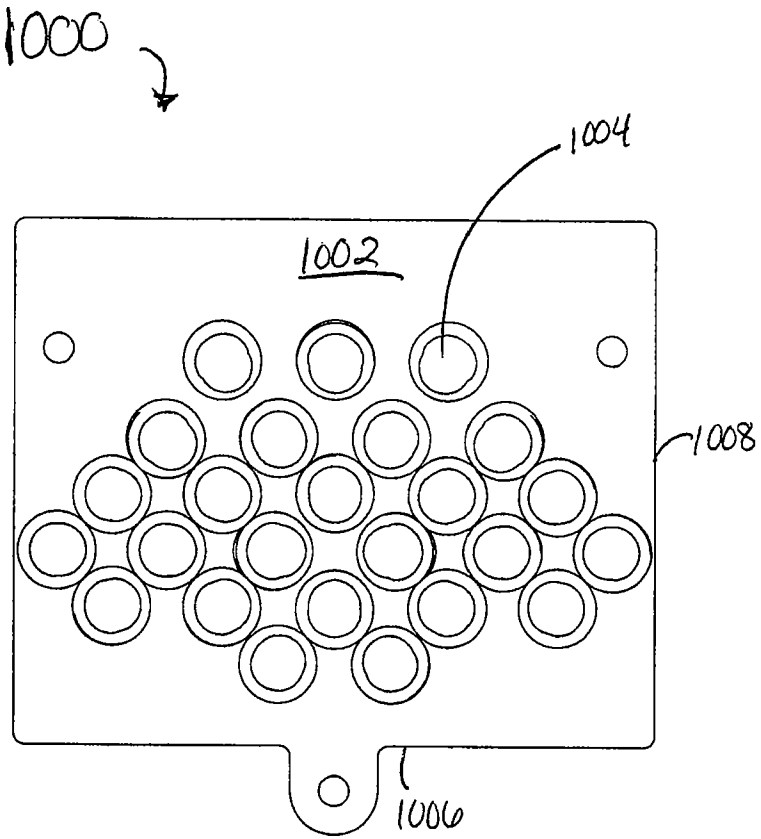
FIG. 10*a* depicts a second embodiment of an array of reflector optics with non-symmetric curvature.
Figure 10B:
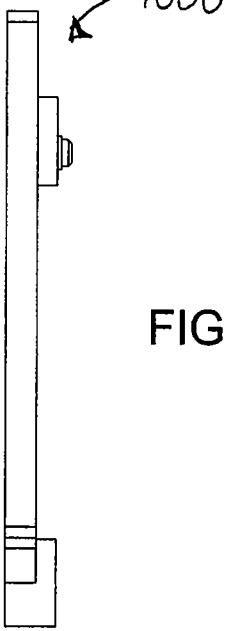
FIGS. 10*b* and 10*c* depict, respectively, side views of the array of FIG. 10*a* from a first edge and a second edge.
Figure 10C:
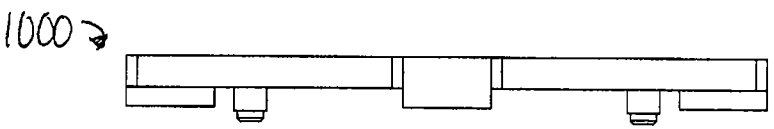

FIG. 10*a* depicts a second embodiment of an array 1000 of reflector optics (i.e., reflector cups 1004) with non-symmetric curvature. As illustrated, the array 1000 comprises a reflective surface 1002 that is the union of a plurality of differently shaped reflector cups 1004. In one embodiment, the reflecting surface of the array 1000 is the result of a plurality of surface forming steps. FIGS. 10*b* and 10*c* depict, respectively, side views of the array 1000 from a first edge 1006 and a second edge 1008.

The array 1000 of reflector optics is arranged so that each reflector cup 1004 emits light about a light emitting axis, and at least some of the light emitting axes are angled outwards from a central optical axis of the array 1000. In one embodiment, the angle of each individual light emitting axis relative to the central optical axis depends on the position of the individual reflector cup 1004 relative to the central optical axis, the dependency being radially symmetric about the central optical axis.

Figure 11A:
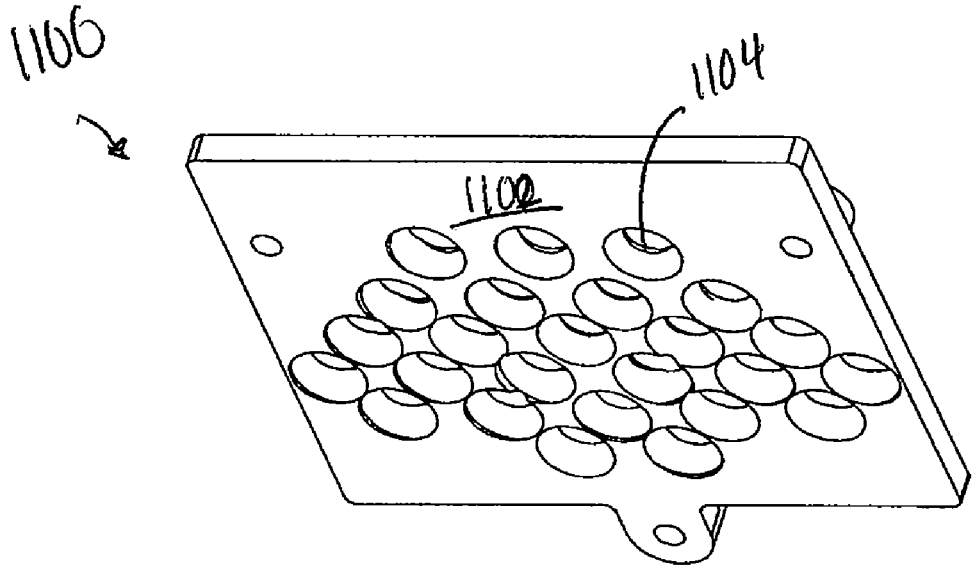
FIG. 11*a* depicts a top perspective view of the array of reflector optics illustrated in FIGS. 10*a*-10*c;*
Figure 11B:
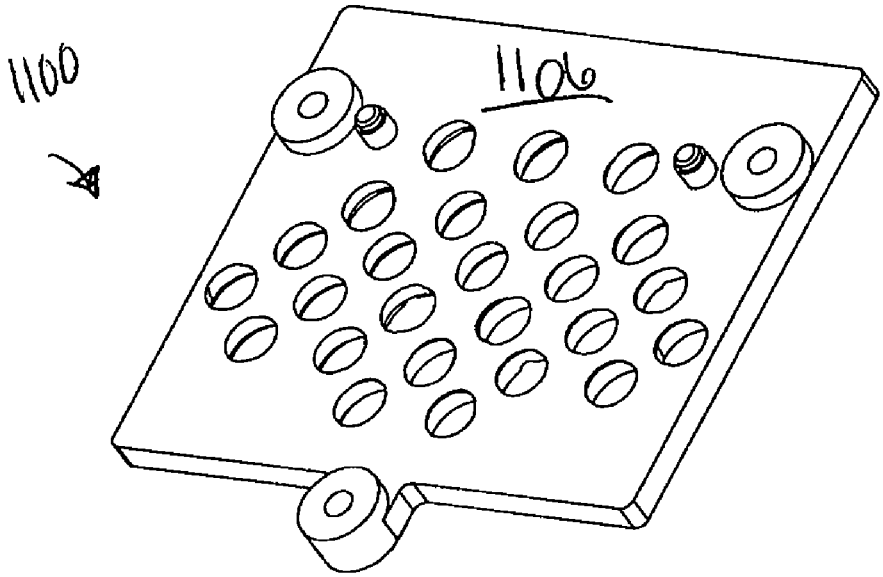
FIG. 11*b* depicts a bottom perspective view of the array of reflector optics illustrated in FIGS. 10*a*-10*c;*

FIG. 11*a* depicts a top perspective view of the array of reflector optics 1000 illustrated in FIGS. 10*a*-10*c*. FIG. 11*b* depicts a bottom perspective view of the array of reflector optics 1000 illustrated in FIGS. 10*a*-10*c*.

Figure 13:
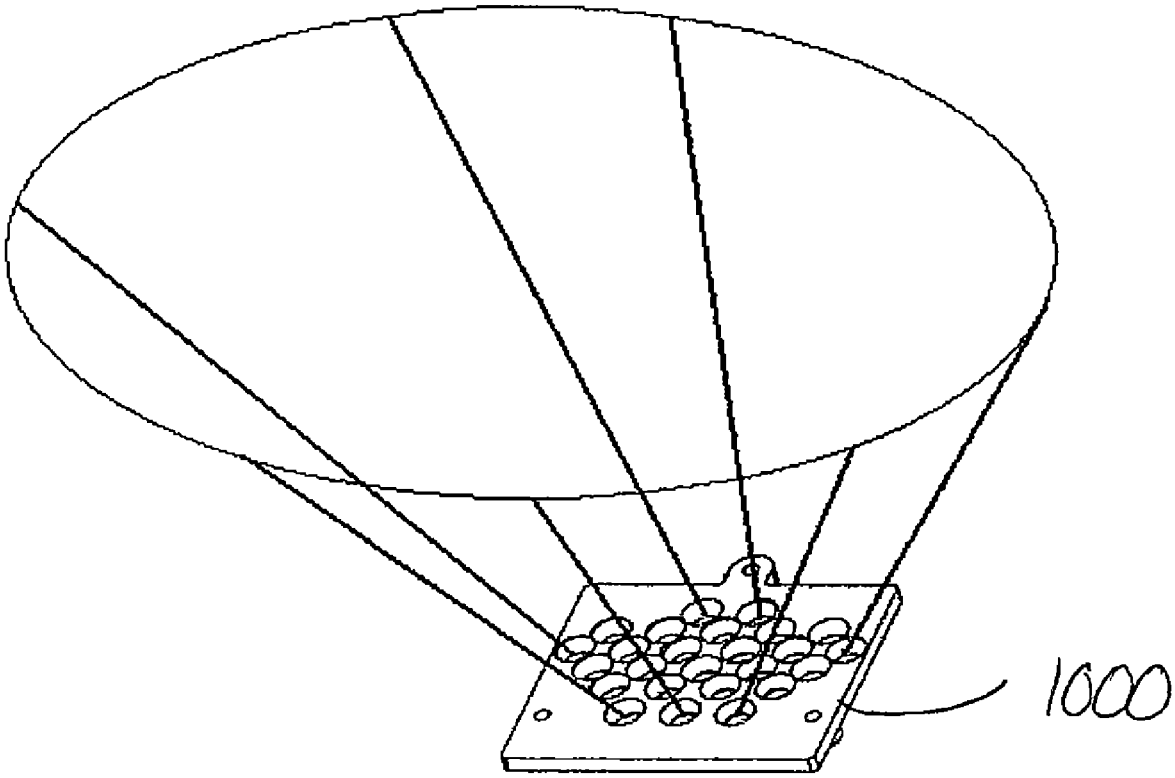
FIG. 13 depicts the manner in which light is directed by the array of reflector cups of FIGS. 10*a*-10*c*.

FIG. 13 depicts the manner in which light is directed by the array 1000 of reflector cups of FIGS. 10*a*-10*c*. As illustrated, the various reflector cups direct light away from the center of the array 1000 and toward various points on the perimeter.

Figures 12A, 12B:
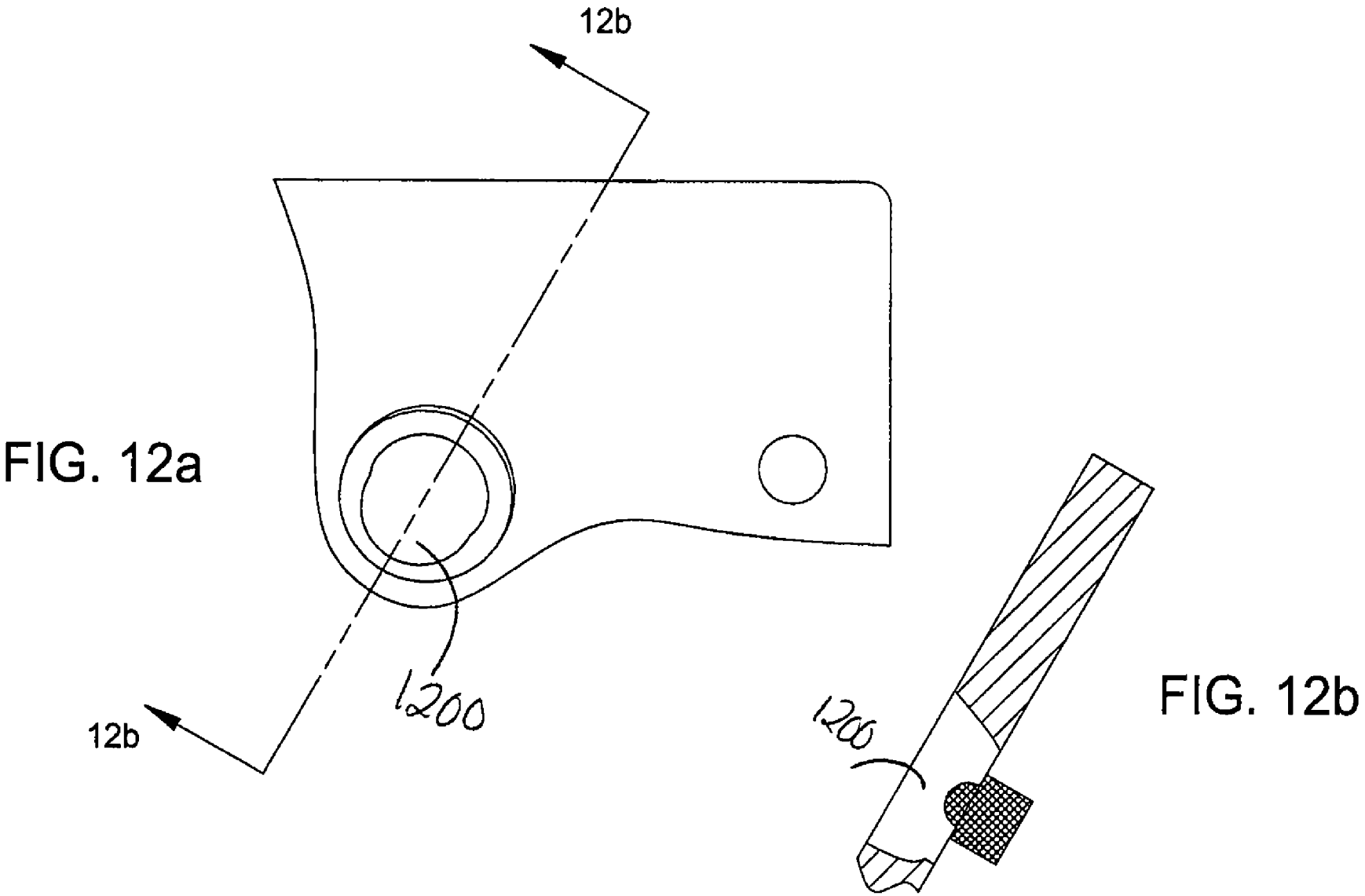
FIG. 12*a* depicts a view of a single reflector cup in an array of reflector cups.
FIG. 12*b* depicts a cross sectional view of the reflector cup of FIG. 12*a* taken along line 12*b*-12*b* of FIG. 12*a;*

FIG. 12*a* depicts a view of a single reflector cup 1200 in an array of reflector cups. FIG. 12*b* depicts a cross sectional view of the reflector cup 1200 taken along line 12*b*-12*b* of FIG. 12*a*.

Thus, the present invention represents a significant advancement in the field of LED-based signal heads. Embodiments of the present invention address the problems of conventional signal head designs by providing an LED light source and an optical system that spreads the light emitted therefrom more uniformly across the lens of a signal assembly than conventional systems.

While the foregoing is directed to embodiments of the present invention, other and further embodiments of the invention may be devised without departing from the basic scope thereof. Various embodiments presented herein, or portions thereof, may be combined to create further embodiments. Furthermore, terms such as top, side, bottom, front, back, and the like are relative or positional terms and are used with respect to the exemplary embodiments illustrated in the figures, and as such these terms may be interchangeable.

What is claimed is:

1. A reflector optic for reflecting light emitted by an array of light-emitting diodes comprising, each light-emitting diode in the array of light-emitting diodes having a peak intensity directed along a center axis, a reflective surface; and a plurality of reflector cups separately formed in a common plane of the reflective surface, at least some of the reflector cups having a non-symmetrical curvature designed to direct light emitted by respective light-emitting diodes such that the peak intensity is shifted away from the center axis, wherein at least two of the at least some of the reflector cups are shaped and positioned to direct light from respective light emitting diodes in different directions away from the center axis.

2. The reflector optic of claim 1, wherein the non-symmetrical curvature is blended.

3. The reflector optic of claim 1, wherein the common plane and the center axis are perpendicular to each other.

4. A signal head, comprising:

an array of light emitting diodes positioned in a common plane, each light emitting diode in the array of light emitting diodes having a peak intensity directed along a center axis; and an array of reflector cups separately positioned in the common plane and positioned to reflect light emitted by the array of light emitting diodes, at least some of the reflector cups having a non-symmetrical curvature, such that the at least some of the reflector cups reflect light from respective light emitting diodes such that the peak intensity is shifted away from the center axis, wherein at least two of the at least some of the reflector cups are shaped and positioned to direct light from respective light emitting diodes in different directions away from the center axis.

5. The signal head of claim 4, further comprising:

a first lens for collimating the light reflected by the array of reflector cups; and a second lens for distributing the light collimated by the first lens.

6. The signal head of claim 5, wherein the first lens is a Fresnel lens.

7. The signal head of claim 4, wherein each reflector cup in the array of reflector cups has a substantially conical shape.

8. The signal head of claim 7, wherein the substantially conical shape is one of: a hyperbola, a parabola, an ellipse, a sphere, an oblate sphere or a modified conic.

9. The signal head of claim 7, wherein the substantially conical shape satisfies:

$$z = \frac{cr^2}{1 + \sqrt{1 - (1 + k)c^2r^2}} + F$$
$$r^2 = x^2 + y^2,$$

wherein k is a conic constant and F is a function.

10. The signal head of claim 4, wherein a first section of a perimeter of each reflector cup in the array of reflector cups has a slope that is at least five degrees greater than a slope of a second section of the perimeter.

11. The signal head of claim 4, wherein the common plane and the center axis are perpendicular to each other.

12. The signal head of claim 4, wherein the non-symmetric curvature is achieved by tilting the at least some of the reflector cups.

13. A method for illuminating a signal head, the method comprising:

providing light via an array of light emitting diodes positioned in a common plane, each light emitting diode in the array of light emitting diodes having a peak intensity directed along a center axis; and reflecting light emitted by the array of light emitting diodes using an array of reflector cups separately positioned in the common plane, at least some of the reflector cups in the array of reflector cups having a non-symmetrical curvature, such that the at least some of the reflector cups reflect light from respective light emitting diodes such that the peak intensity is shifted away from the center axis, wherein at least two of the at least some reflector cups are shaped and positioned to direct light from respective light emitting diodes in different directions away from the center axis.

14. The method of claim 13, wherein each individual reflector cup has a substantially conical shape.

15. The method of claim 14, wherein the substantially conical shape is one of:

a hyperbola, a parabola, an ellipse, a sphere, an oblate sphere or a modified conic.

16. The method of claim 14, wherein the substantially conical shape satisfies:

$$z = \frac{cr^2}{1 + \sqrt{1 - (1 + k)c^2r^2}} + F$$
$$r^2 = x^2 + y^2,$$

wherein k is a conic constant and F is a function.

17. The method of claim 13, wherein a first section of a perimeter of each individual reflector cup has a slope that is at least five degrees greater than a slope of a second section of the perimeter.

18. The method of claim 13, wherein the non-symmetrical curvature is achieved by tilting the at least some of the reflector cups.

19. The method of claim 13, wherein the non-symmetrical curvature is blended.

20. The method of claim 13, wherein the common plane and the center axis are perpendicular to each other.

* * * * *

UNITED STATES PATENT AND TRADEMARK OFFICE

CERTIFICATE OF CORRECTION

PATENT NO. : 7,810,963 B2
APPLICATION NO. : 11/684453
DATED : October 12, 2010
INVENTOR(S) : John Patrick Peck It is certified that error appears in the above-identified patent and that said Letters Patent is hereby corrected as shown below:

First page, Column 2, OTHER PUBLICATIONS, line 2, delete "contains" and insert -- copy contains --, therefor.

Column 6, line 23, in claim 1, delete "comprising," and insert -- comprising: --, therefor.

Column 6, line 25, in claim 1, delete "axis," and insert -- axis: --, therefor.

Signed and Sealed this
Twenty-second Day of February, 2011

David J. Kappos

David J. Kappos
*Director of the United States Patent and Trademark Office*